US005261585A

United States Patent [19]

Simhaee

[11] Patent Number: 5,261,585

[45] Date of Patent: * Nov. 16, 1993

[54] PLASTIC BAG DISPENSER

[76] Inventor: Ebrahim Simhaee, 112 N. Maple Dr., Beverly Hills, Calif. 90210

[ * ] Notice: The portion of the term of this patent subsequent to Jun. 15, 2010 has been disclaimed.

[21] Appl. No.: 821,192

[22] Filed: Jan. 21, 1992

Related U.S. Application Data

[63] Continuation-in-part of Ser. No. 652,031, Feb. 7, 1991, Pat. No. 5,135,146, and a continuation-in-part of Ser. No. 764,137, Sep. 20, 1991, Pat. No. 5,219,424.

[51] Int. Cl.[5] ..... B26F 3/02; B65D 85/671

[52] U.S. Cl. ..... 225/47; 225/79; 225/85; 225/90; 225/106

[58] Field of Search ..... 225/46, 47, 51, 76, 225/77, 80, 82, 85, 90, 106; 242/55.3

[56] References Cited

U.S. PATENT DOCUMENTS 1,973,354 9/1934 Nedberg ..... 225/76
2,304,312 12/1942 Meglitz ..... 225/47
3,154,232 10/1964 Gage ..... 225/46
4,179,055 12/1979 Milner ..... 225/91
5,135,146 8/1992 Simhaee ..... 225/80

*Primary Examiner*—Hien H. Phan
*Attorney, Agent, or Firm*—Darby & Darby

[57] ABSTRACT

A plastic bag dispenser holds a continuous roll of bags, connected by perforated separation lines. The dispenser is provided with a tongue, which the bags are dispensed over, that engages the separation line between the bag at the end of the roll and the next bag. This begins the separation of the separation line, as well as holds the next bag behind the tongue. A finger is provided on the upstream side of the tongue, with a gap between the finger and tongue. As a bag is separated, a portion of the front edge of the next bag is held in the gap, holding the bag in position for the next user. The roll of bags rests in angled grooves in the dispenser that cause the roll to abut and frictionally engage an interior surface of the dispenser, preventing free-wheeling of the roll.

5 Claims, 4 Drawing Sheets

PLASTIC BAG DISPENSER

This is a continuation-in-part of U.S. patent application Ser. No. 07/652,031, filed Feb. 7, 1991, entitled "Plastic Bag Dispenser," now U.S. Pat. No. 5,135,146, and a continuation-in-part of U.S. patent application Ser. No. 07/764,137, filed Sep. 20, 1991, entitled "Roll of Plastic Bags for Use With Bag Dispensing Device," now U.S. Pat. No. 5,219,424 both in the name of Ebrahim Simhaee.

FIELD OF THE INVENTION

This invention relates to devices for dispensing a continuous web of articles. Specifically, the invention relates to plastic bag dispensers, such as the type used for self-service produce, grocery, or garbage bags.

BACKGROUND OF THE INVENTION

In a supermarket or food market, fruits and vegetables are often displayed in bulk, possibly in piles of loose items. Consumers must then take a bag from a nearby source and pick and bag their own produce. The most common form of these produce bags are cylindrical rolls of plastic bags, mounted horizontally or vertically on a shaft. The bags have perforated separation lines between them. Separation is accomplished by grabbing the end bag with one hand, anchoring the next bag or the roll with the other hand, and pulling. Unfortunately, this not only separates the bag from the roll, but can deform or even tear the bag. Sometimes, consumers will attempt to simply jerk the bag from the roll, without holding the adjacent bag. This, too, can damage the bag or simply reel out the roll. After any bag separation, the end of the next bag can be difficult to find or grab as it may lie flat on the surface of the roll.

It is thus an object of the invention to provide an improved dispenser for a continuous web of articles.

It is a further object of the invention to provide a dispenser with improved means for easily separating articles from a continuous web with one-handed operation and retaining the next article in an easily accessible position.

It is a further object of the invention to provide an improved means for preventing free-wheeling of the continuous web during dispensing.

It is a further object of the invention that the dispenser be economical and simple to manufacture.

SUMMARY OF THE INVENTION

In accordance with the objects of the invention, a plastic bag dispenser holds a continuous roll of bags, connected by perforated separation lines. The dispenser is provided with a tongue, which the bags are dispensed over, that engages the separation line between the bag at the end of the roll and the next bag. This begins the separation of the separation line, as well as holds the next bag behind the tongue. A finger is provided on the upstream side of the tongue, with a gap between the finger and tongue. As a bag is separated, a portion of the front edge of the next bag is held in the gap, holding the bag in position for the next user. The roll of bags is mounted in the dispenser so that the roll frictionally engages an interior surface of the dispenser.

BRIEF DESCRIPTION OF THE DRAWINGS

The foregoing and other objects and advantages of this invention will become apparent to those skilled in the art upon reading the detailed description of a preferred embodiment in conjunction with a review of the appended drawings in which.

DETAILED DESCRIPTION OF THE PREFERRED EMBODIMENTS

Figure 1:
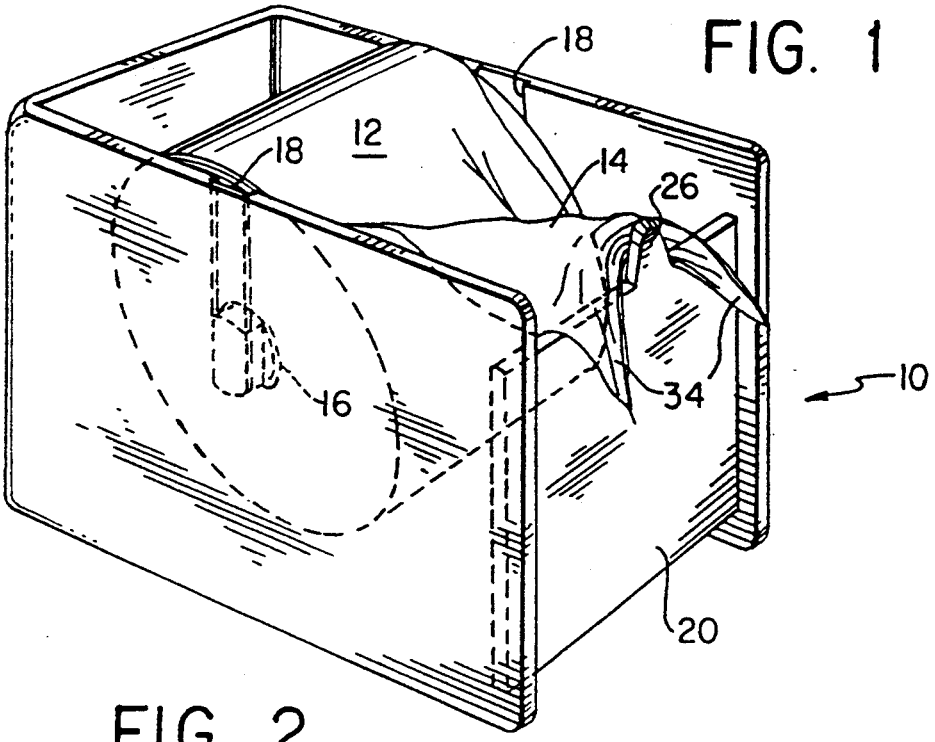
FIG. 1 is a perspective view of a first embodiment of the invention, after a bag has been separated and removed.

A dispenser includes a generally rectangular box 10 for housing a continuous roll of articles 12. Individual articles 14 may be sheets of plastic, preferably pre-fabricated into sealed bag-like containers disposed in a unitary end-to-end relationship. The top of the box 10 is open for quick replacement of the roll 12, which rotates on an axle 16. The two ends of the axle 16 rest in two grooves 18 cut into the interior faces of the side walls of the box 10. The grooves 18 extend to the top of the side walls, where the axle 16 is inserted. One end of the axle 16 preferably has notches 19 and the corresponding groove 18 is narrowed to prevent rotation of the axle 16 during rotation of the roll 12. One end wall 20 has a lower top surface than the other three walls. The bags 14 are dispensed over the top surface of the end wall 20.

Each bag 14 is sealed at one end and connected to adjacent bags by a perforated separation line 22. At the center of the separation line 22 is a slot 24, although the slot 24 can be placed at other positions on the separation line 22. Integrally molded with the end wall 20 and extending upward beyond the wall 20 is a tongue 26. The tongue 26 is positioned at the center of the top surface of the wall 20 to receive the slot 24. The tongue 26 preferably has a half-oval shape with its top surface angled upward, the higher side being toward the inside of the box 10.

Either integrally molded with or preferably attached to the interior surface of the end wall 20, adjacent the tongue 26, is a finger 28 that extends inwardly from the wall 20. The upper limit of the finger 28 is below the top of the tongue 26, but above the upper surface of the end wall 20. The top of the finger 28 is preferably rounded convexly in the direction of travel of bags 14 to facilitate the movement of bags over the finger 28. Between the upper portions of the tongue 26 and finger 28 is a V-shaped gap 30, perpendicular to the direction of travel of the bags 14, which receives the leading edge of an upstream bag after a slot 24 between two bags 14 has been engaged by the tongue 26.

Figure 2:
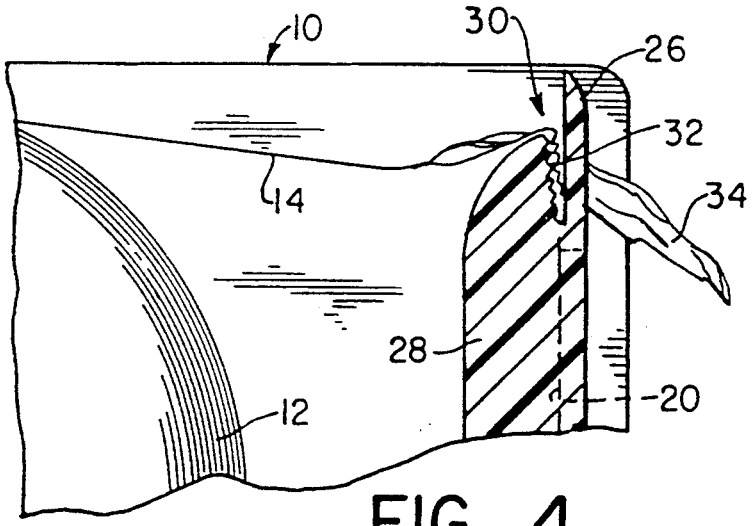
FIG. 2 is a side cross-section of the tongue/finger assembly shown in FIG. 1, showing the next bag partially inserted in the gap.
Figure 3:
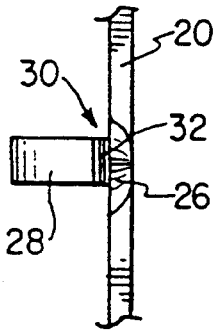
FIG. 3 is a top view of the tongue/finger assembly of FIG. 2.
Figure 4:
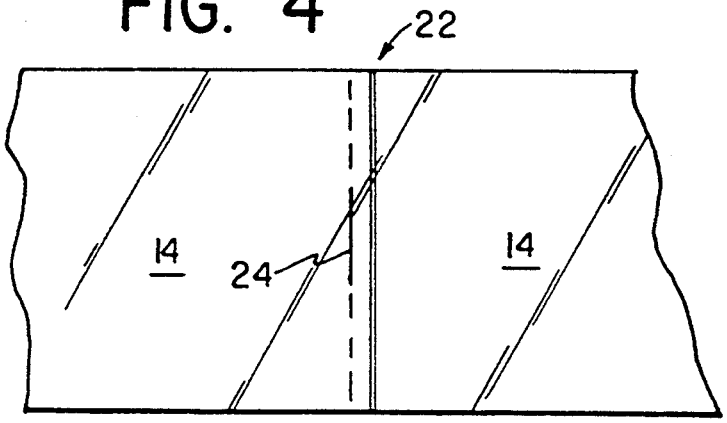
FIG. 4 is a detail of the separation line between two adjacent bags on the continuous roll.

Within the gap 30 are means 32 to impede but not prohibit the upward movement of a portion of a bag 14 out of the gap 30, while not impeding downward movement into the gap. This means is preferably a set of downwardly-angled horizontal teeth 32 on the surface of the finger 28 within the gap 30, as shown in FIG. 2.

In practice, a consumer would find the dispenser in a condition as in FIG. 1, with a portion of a leading edge of an end bag 34 within the gap 30 and the two leading corners of the end bag 34 extending forward past the end wall 20. The consumer grabs the portion of the end bag 34 extending forward of the end wall and pulls it upward and forward, away from the roll 12, extricating the bag 34 from the gap 30. The teeth 32 are designed so that only minimum force is required to extricate the bag 34 from the gap 30, avoiding damage to the bag. While pulling the end bag 34 away from the roll 12, the consumer pulls the bag 34 over the tongue 26 and then at an angle below horizontal, preferably to below the level of the bottom of the gap 30, so that the tongue will contact the underside of the bag 34 as the bag travels. Eventually, the tongue 26 will engage the slot 24 at the trailing end of the end bag 34, splitting the slot 24 over the tongue 26. The center of the leading edge of the next bag will then travel down into the gap 30 and remain there.

Further forward motion of the end bag 34, in response to force by the consumer, will result in the ends of the separation line 22 bending forward around the tongue 26. The separation line 22 will then separate starting at the slot 24 and progressing outward toward both ends of the line 22. After complete separation and removal of the end bag 34, the dispenser will again be as in FIG. 1, with a new end bag ready for the next consumer. Because of the downward-facing teeth 32 in the gap, the bag 34 will tend to remain in the gap 30 until such time as a consumer pulls upward on the leading edge. The dispenser will thus constantly be in a ready state, until the roll of bags 12 is depleted.

Figure 7:
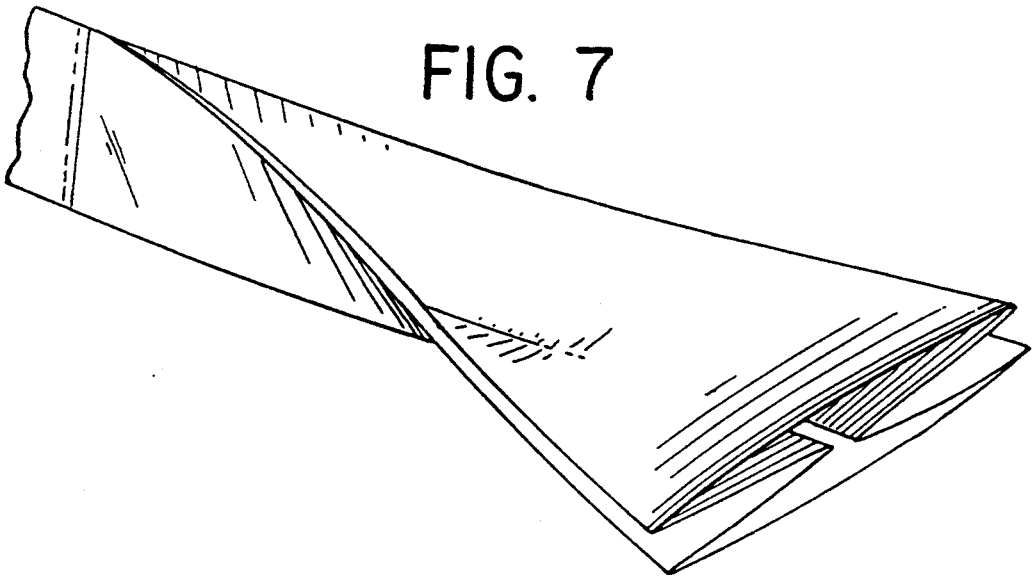
FIG. 7 illustrates the preferred configuration of the plastic bags in accordance with the invention.
Figure 8:
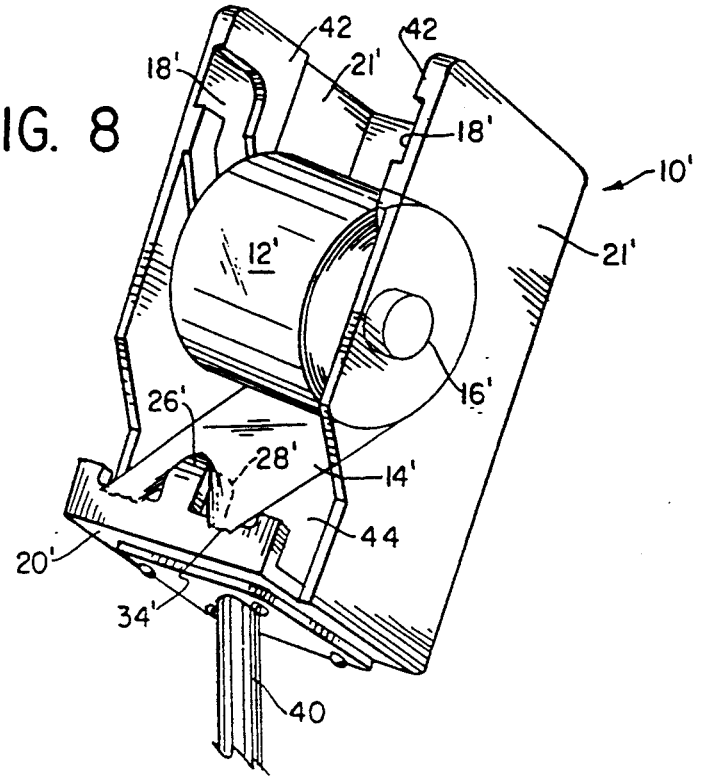
FIG. 8 is a perspective view of a second embodiment of a dispenser according to the invention.
Figure 9:
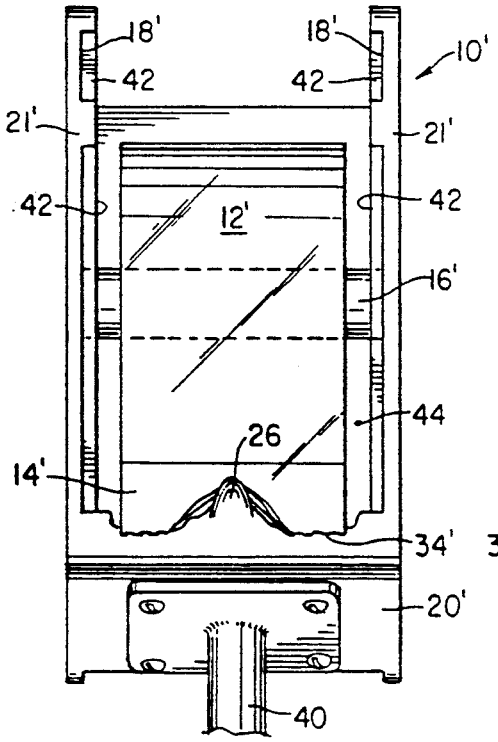
FIG. 9 is a front view of the dispenser of FIG. 8.

Many different types of plastic bag configurations are commonly used and the principles of the invention do not require a specific configuration; however, in the preferred embodiments, a so-called "star seal" configuration as shown in FIG. 7 is employed because it is somewhat easier to open and provides a strong seal at the bottom. Whatever the configuration, the width of the roll relative to the width of the tongue 26 should be such that when a bag is severed from the roll, the edges of the next contiguous bag are pulled forwardly of the tongue a sufficient distance so that they can be grasped readily by the user.

Figure 5:
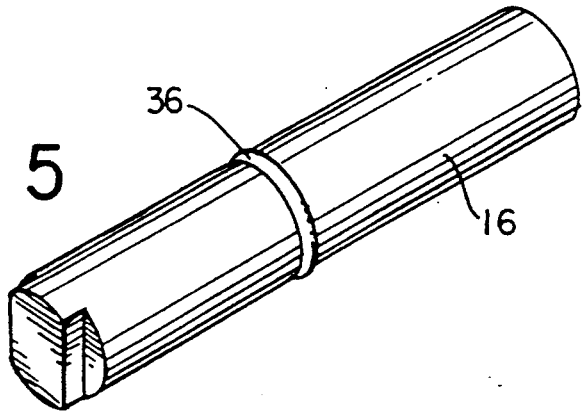
FIG. 5 is a perspective view of the axle.

When a consumer pulls on the end bag 34, a significant amount of rotational momentum is gained by the roll 12. In this embodiment, the bags are wrapped around a cylindrical core 15 which is mounted on the axle 16 with sufficient clearance that the core 15 and roll 12 can rotate relative to the axle 16. To prevent the roll 12 and core 15 from free-wheeling and reeling out several bags as the end bag 34 is dispensed, the axle 16 with notches 19 is preferably provided with a rubber O-ring 38, as in FIG. 5, that frictionally engages the core 15 of the roll 12. Other materials besides rubber will work similarly. In known devices, an O-ring is slipped onto the axle, and over time, tends to slip off one of the ends. To prevent axial movement of the O-ring 38 on the axle 16, the axle 16 is provided with a circumferential groove 36, in which the O-ring 38 rests. The groove 36 is dimensioned so that a portion of the O-ring 38 will extend beyond the outer surface of the axle 16.

The construction of the dispenser allows for simple mounting to any surface, be it horizontal, vertical or otherwise, by conventional means, such as with screws or glue. It also can be free standing, with one hand holding the box 10, if necessary, while the other pulls the end bag 34. The dispenser may also be formed of a light-transmissive material to give the owner of the dispenser ample warning that a roll 12 is nearly depleted.

In the embodiment of FIGS. 8–13, a dispenser 10′ is preferably mounted at a few degree angle from the vertical. From one end wall 20′, a tongue 26′ and finger 28′ are mounted on and perpendicular to the top surface of the wall 20′, facing inward. The entire dispenser is preferably mounted on a pole 40 or any other surface that will maintain its angled configuration with respect to the vertical, as described more fully below.

Figure 6:
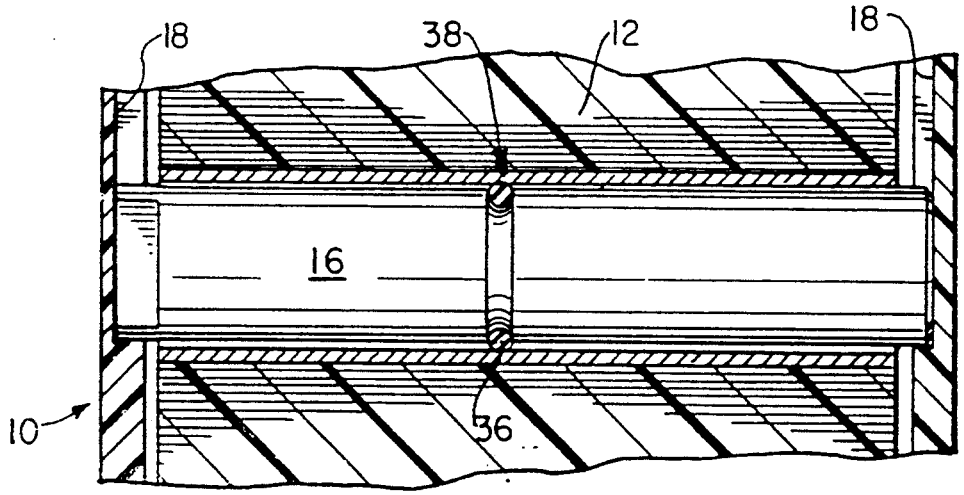
FIG. 6 is a partial cross-section of the embodiment of FIG. 1, showing the axle and the O-ring.
Figure 10:
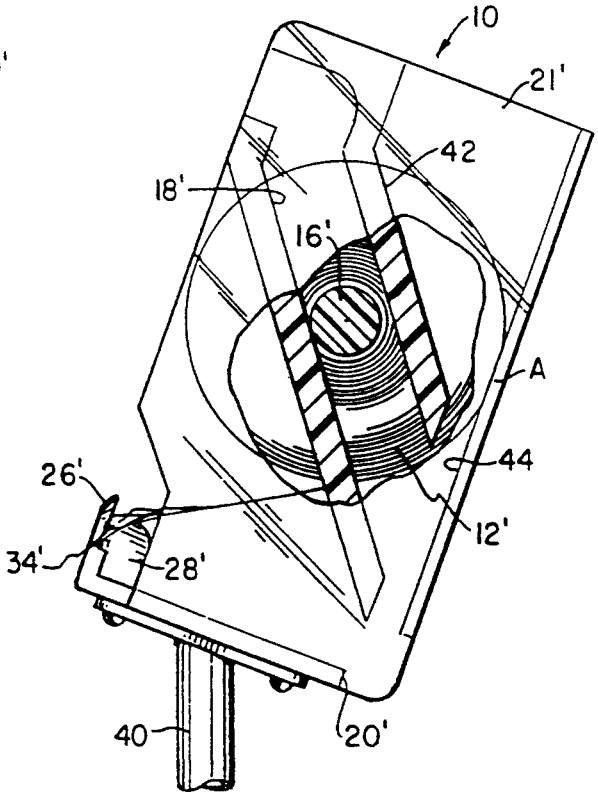
FIG. 10 is a side partial cross-section view of the dispenser of FIG. 8.

As seen most clearly in FIG. 10, the grooves 18′ in the sidewalls 21′ are preferably formed by guides 42, although they could be impressed into the walls 21′ as with the embodiment of FIG. 1. The grooves 18′ also are angled with respect to wall 20′ so that the roll of bags 12′ will be biased against the interior bottom surface 44 of the dispenser 10′, engaging the surface 44 at position A. As seen in FIG. 10, the area of frictional contact between the roll 12′ and the surface 44 will move closer or farther from wall 20′ depending on the size of the roll 12′. The angle of the grooves 18′ with respect to the vertical of course depends on the mounting angle oft he dispenser 10′, so the mounting angle should be chosen so that gravitational force alone will move the axle 16′ down the grooves 18′ and force the roll 12′ against the surface 44. Due to this frictional contact with the surface 44, the axle 16′ need not include notches at its end (see FIG. 10) to prevent free-wheeling, nor the O-ring and groove seen in FIG. 6, since the frictional contact between the outer bag of the roll 12′ and the bottom surface 44 will serve the same purpose.

The roll 12′ is placed into the dispenser 10′ merely by slipping the axle 16′ into the grooves 18′, since there are no axle notches to be aligned with the groove as in the embodiment of FIG. 1. The tolerance with respect to the length of the axle 16′ and the corresponding distance between the grooves 18′ should be relatively close, since an axle that is too short may become angled from its normal position perpendicular to the walls, causing the edges of the roll 12′ to engage the grooves 18′ or guides 42 as it turns, potentially damaging the bags 14′.

It can be seen that the roll 12′ is preferably positioned within the dispenser 10′ so that the bags 14′ will be dispensed from the underside of the roll 12′, instead of over the top as shown in FIG. 1. Preferably, the pole 40 and dispenser 10′ would be mounted on a table top surface (not shown) so that the dispenser 10′ is approximately at least the height of an average standing consumer's abdomen. This will allow the consumer to pull outward and downward on the end bag 34′ in a natural movement of the arm. This will make also it convenient for a person to pull up slightly on the leading edge of the end bag 34′ to dislodge it from the gap 30′ for dispensing. With the bags dispensed from the underside of the roll 12' and the position and angle of the tongue 26' and finger 28', the possibility of a consumer pulling a bag 34' from the dispenser 10' above and away from the tongue 26', which would defeat a significant purpose of the invention, is greatly decreased.

Figure 11:
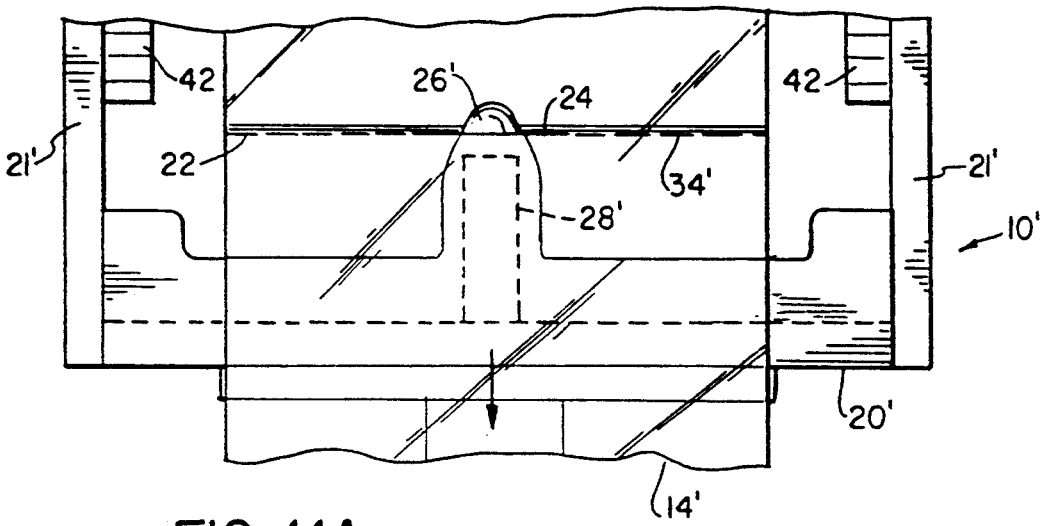
FIG. 11 is a detail view of the tongue/finger assembly of the dispenser of FIG. 8, showing the next bag partially engaged by the tongue.
Figure 11A:
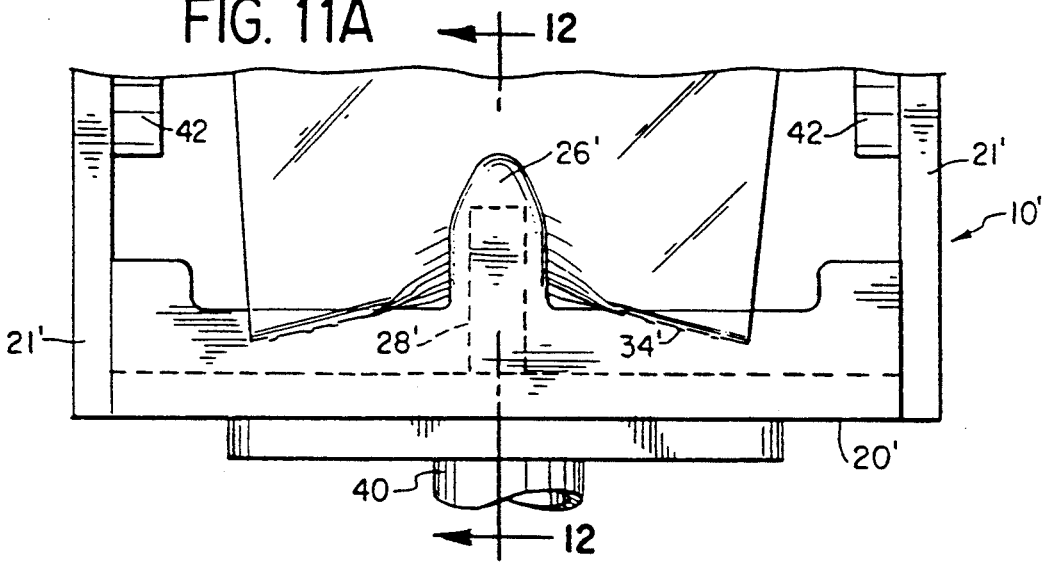
FIG. 11A is a detail view as in FIG. 11, after dispensing a bag.
Figure 12:
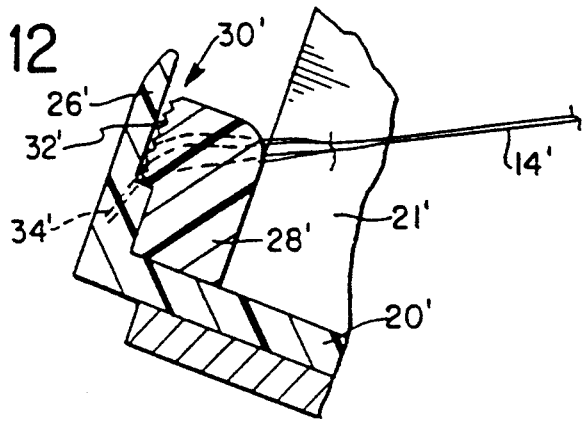
FIG. 12 is a cross-section taken along the line 12—12 of FIG. 11A.

The essential functioning of the tongue 26' and finger 28' with respect to engaging and separating bags 14' is identical to that of the embodiment of FIG. 1, except that the tongue 26, and finger 28' are perpendicular to the position of FIG. 1. Similar teeth 32' are also present in the gap 30'. An end bag 34' being separated and dispensed is shown in FIGS. 11-12.

Some economy of material is possible with the dispensers of the present invention. For example, the embodiment of FIGS. 8-12 has only three walls, the fourth being unnecessary. In the same embodiment, the roll 12' may be directly mounted onto an axle 16', without the need for a core as in the embodiment of FIG. 1. The axle 16' may also formed of a hollow, recyclable material.

While the embodiments of the invention shown and described are fully capable of achieving the results desired, it is to be understood that these embodiments have been shown and described for purposes of illustration only and not for purposes of limitation.

What is claimed is:

1. A dispenser for dispensing and separating an article from a cylindrical roll of articles having separation lines between said articles, comprising:

a container for holding said continuous roll;

a tongue attached to said container for engaging a slot in said separation lines between said articles during dispensing and separation;

a finger attached to said container and positioned adjacent said tongue, such that a gap is formed between said tongue and said finger, said gap positioned to receive a portion of a second article adjacent said article to be separated and retain said portion, said gap being adapted to allow said portion to depart from said gap only in the direction from which it was received; and means for mounting said cylindrical roll connected to said container, said means constructed such that said roll will frictionally engage said container to provide resistance against dispensing said articles.

2. A dispenser according to claim 1, further comprising an axle mounted on said means for mounting for rotatably suspending said roll of articles.

3. A dispenser according to claim 2 wherein said means for mounting comprises two grooves in said container, said axle being suspended by and between said grooves.

4. A dispenser according to claim 3 wherein said grooves are angled with respect to the vertical such that said roll will frictionally engage said container as said articles are separated from said roll.

5. A dispenser according to claim 4 wherein said grooves are comprised of raised guides connected to said container.

* * * * *